United States Patent [19]

Deussen

[11] Patent Number: 4,845,946

[45] Date of Patent: Jul. 11, 1989

[54] METHOD OF PRODUCING MOTTLED ROTOR SPUN YARN

[75] Inventor: Helmut Deussen, Charlotte, N.C.

[73] Assignee: W. Schlafhorst & Co., Fed. Rep. of Germany

[21] Appl. No.: 159,773

[22] Filed: Feb. 24, 1988

[51] Int. Cl.[4] ..... D01H 1/12

[52] U.S. Cl. ..... 57/409; 57/408; 57/224

[58] Field of Search ..... 57/5, 6, 12, 207, 208, 57/210, 224, 227, 400, 404, 408, 409

[56] References Cited

U.S. PATENT DOCUMENTS

| | | | |
|---|---|---|---|
| 3,365,872 | 1/1968 | Field | 57/224 |
| 3,864,902 | 2/1975 | Wehling et al. | 57/409 |
| 4,050,228 | 9/1977 | Landwehrkamp et al. | 57/409 X |
| 4,302,925 | 12/1981 | Edagawa et al. | 57/5 X |
| 4,321,789 | 3/1982 | Dammann et al. | 57/224 |
| 4,330,988 | 5/1982 | Eschenbach | 57/208 X |
| 4,403,470 | 9/1983 | Nelso | 57/5 |
| 4,711,080 | 12/1987 | Shibazaki et al. | 57/208 X |

*Primary Examiner*—Donald Watkins

*Attorney, Agent, or Firm*—Shefte, Pinckney & Sawyer

[57] ABSTRACT

A mottled appearing yarn having a main strand of fibers and wrapper fibers of different color than the main strand. The yarn is produced by feeding longer and coaser fibers with shorter and finer fibers in an open end rotor spinning machine and controlling the operation to accentuate wrapper fiber formation with the longer and coarser fibers. The wrapper fiber formation is accentuated by using a relatively low rotor diameter to fiber length ratio and by using an aggressive navel action.

12 Claims, 3 Drawing Sheets

METHOD OF PRODUCING MOTTLED ROTOR SPUN YARN

BACKGROUND OF THE INVENTION

The present invention relates to open end rotor spun yarn and the method of producing such yarn. More particularly, the present invention relates to such a yarn and method wherein the presence of wrapper fibers is accentuated to provide a mottled appearance in the yarn and resulting fabric made therefrom.

As the technology of open end rotor spinning of yarn has developed, the primary goal has been to produce a yarn having the characteristics and qualities of ring spun yarn, i.e., a relatively strong, soft, uniform yarn. The main obstacle in obtaining this goal has been the undesirable inherent formation of wrapper fibers on the surface of the yarn, which result from some fibers not being twisted uniformly with the other fibers but rather wrapped tightly around the yarn and having ends that project from the wrapping without significant intertwining in the yarn, thus creating a harshness in hand, an undesirable appearance, and a relatively weak structure.

In the process of open end rotor spinning, the loose fibers are fed to the conical inner wall of the rotor with the fibers transferring along the wall into the rotor groove from which they are withdrawn and twisted in a generally orderly manner to form the yarn. The fibers acting in this way form a main strand that can be made by controlling the processing parameters to have characteristics and qualities closely resembling those of ring spun yarn. However, due to the nature of open end rotor spinning all of the fibers do not follow this orderly formation. Rather, some fibers, particularly those that feed to the rotor groove as the revolving drawoff of the yarn formation passes the yarn feed location, do not intertwine orderly with the other fibers but wrap rather tightly around the yarn and have ends that project randomly. These wrapper fibers not only serve no purpose and provide no strength to the yarn, but they make the yarn coarse in hand and sight. Furthermore, we need to increase the twist imparted to open end spun yarn in order to enhance the strength necessary to be able to spin fine yarn has accentuated the wrapper fiber formation.

SUMMARY OF THE INVENTION

In the present invention, rather than being concerned with the minimizing of wrapper fibers as has been the practice, the presence of wrapper fibers is accentuated and taken advantage of in a unique manner to provide an attractive mottled appearance. This is accomplished by providing an operational environment that promotes the formation of wrapper fibers and by feeding a composition of fibers into the rotor that includes relatively long, coarse fibers of the type that have a tendency to form wrapper fibers, which long, coarse fibers are of a different color characteristic than the other fibers so that the wrapper fibers have a pronounced discrete appearance in the ultimate yarn and fabric.

Briefly described, the pen end rotor spun yarn of the present invention has a mottled appearance, with the predominant fibers of the wrapper fibers being of greater wrapper fiber forming, lesser main strand fiber forming and different color characteristics than the fibers that predominate the main strand. Thus, the wrapper fibers are accentuated and utilized to an advantage to obtain conspicuous random spots of contrasting color characteristics along the length of the yarn and the ultimate fabric to obtain an attractive mottled appearance.

The fiber characteristics that are relevant to the present invention include fiber length and fiber diameter, with the predominant wrapper fibers being greater than the predominant main strand fibers in at least one of length and diameter characteristics, and preferably greater in both characteristics.

In the preferred embodiment of the yarn of the present invention, the predominant wrapper fibers are at least approximately one and one-half inches in length and of a size at least approximately equivalent to one and one-half denier. An example of a yarn of this type has the predominant wrapper fibers formed of acrylic or nylon dyed in a conspicuous color, and white or noticeably differently colored predominant main strand fibers of cotton and polyester. The cotton fibers are approximately one inch long and of a size approximately the equivalent of three to four micronaire, with the polyester fibers being approximately one and one-quarter inches long and of a size approximately the equivalent of one denier. The mix of fibers is approximately 42% cotton, 42% polyester and 16% acrylic or rayon.

In the method of the present invention, a combination of fibers as described above is fed to a rotor from which the fibers are withdrawn in the form of a yarn while inducing wrapper fiber formation by the fibers that are provided for the particular purpose of forming wrapper fibers. This inducing of formation of wrapper fibers is preferably obtained by using a rotor of relative small diameter in comparison with the length of the wrapper forming fibers. For example, the ratio of the diameter of the rotor to the length of the wrapper forming fibers may be less than approximately 1.2 while the ratio of the diameter of the rotor to the length of the main strand forming fibers is greater than the ratio of the rotor diameter to the length of the wrapper forming fibers. In the preferred embodiment, the ratio of the diameter of the rotor to the length of the wrapper forming fibers is more nearly 0.8 than 1.2 and more particularly is approximately 0.95. This can be obtained by feeding the combination of fibers to a rotor having a diameter of approximately 36 millimeters, with the main strand fibers being predominantly cotton and polyester with the ratio of rotor diameter to the length of the fibers being approximately 1.44 for the cotton fibers and approximately 1.12 for the polyester fibers.

Also, in the preferred embodiment, the method includes drawing the fibers from the rotor through a navel while applying aggressive navel action to reduce twisting and enhance softness of the resultant yarn. In this way characteristics as close to ring spun yarn can be obtained while still accentuating wrapper yarn formation to obtain the mottled appearance.

Other further advantages and features of the present invention will be apparent from the accompanying drawings and the following detailed description of the preferred embodiments.

DETAILED DESCRIPTION OF THE PREFERRED EMBODIMENTS

Figure 1:
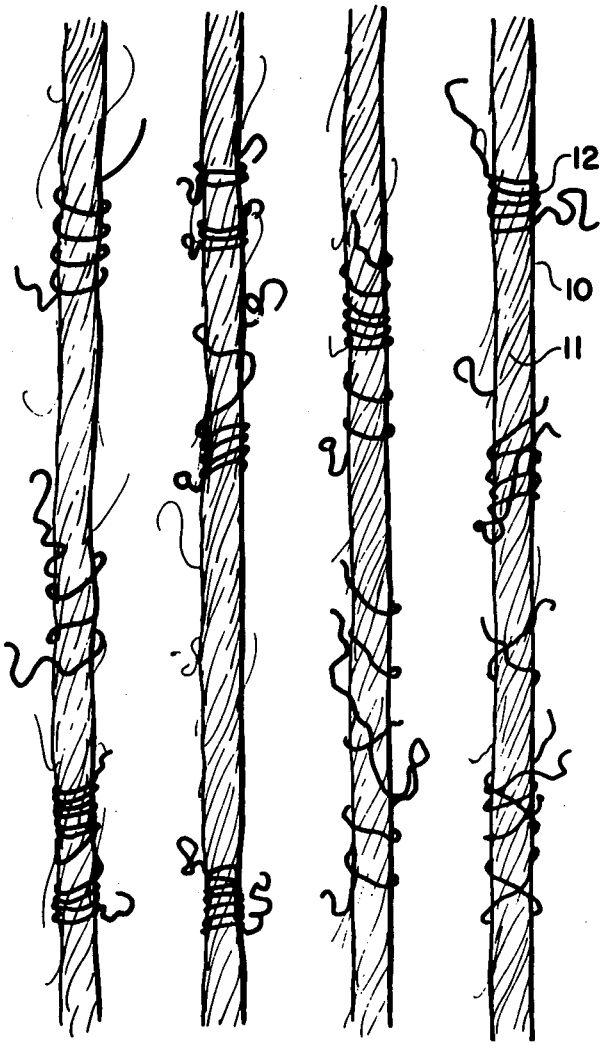
FIG. 1 illustrates an open end rotor spun yarn incorporating the preferred embodiment of the present invention.

The yarn 10 of the preferred embodiment of the present invention is illustrated in FIG. 1. It is of the open end rotor spun type having fibers that are twisted or spun together forming a main strand 11 in the yarn 10 and having other fibers that are wrapped around the main strand 11 in the form of wrapper fibers 12. The fibers in the main strand 11 predominate over the wrapper fibers 12 in the composition of the yarn 10, with some of the fibers of the type that predominate the main strand 11 ending up as wrapper fibers and some of the fibers of the type that predominate the wrapper fibers ending up in the main strand The predominant fibers in the main strand and the predominant fibers in the wrapper fibers differ in wrapper fiber forming, main strand forming and color characteristics, with the predominant wrapper forming fibers having greater wrapper fiber forming characteristics and lesser main strand forming characteristics. The different color characteristics are typified by the predominant wrapper fibers 12 being of a different color than the predominant fibers of the main strand 11, which may result from the fibers being of a different color or being of a different dye affinity so that the yarn can be subsequently dyed with resulting color differences. In the embodiment illustrated, the predominant wrapper fibers 12 are black or dark in comparison with light (gray or white) predominant fibers of the main strand 11. As a result, the yarn and fabric made therefrom have the appearance of dark specks or spots randomly scattered in a lighter background.

The difference in the characteristics of the predominant wrapper fiber forming fiber and the characteristics of the predominant main strand forming fibers includes differences in fiber length or fiber diameter or both, with the predominant wrapper fiber forming fiber being greater in length or diameter or both than the characteristics of the predominant main strand forming fibers. In the preferred embodiment the predominant wrapper fibers are at least approximately one and one-half greater than the predominant main strand fibers in one or the other or both length and diameter characteristics. For this purpose, the predominant wrapper fibers may be at least approximately one and one-half inches in length and of a size at least approximately equivalent to one and one-half denier.

In an example of the preferred embodiment of the yarn 10 of the present invention, the predominant main strand fibers are a combination of cotton and polyester fibers and the predominant wrapper fibers are colored fibers of acrylic or rayon. The cotton fibers are approximately one inch long and of a size approximately the equivalent of three to four micronaire, the polyester fibers are approximately one and one-quarter inches long and of a size approximately the equivalent of one denier, and the acrylic or rayon fibers are approximately one and one-half inches long and of a size the equivalent of one and one-half denier. The cotton fibers constitute approximately 42% of the fibers in the yarn, the polyester fibers constitute approximately 42% of the fibers in the yarn, and the acrylic or rayon fibers constitute approximately 16% of the fibers.

Figure 2:
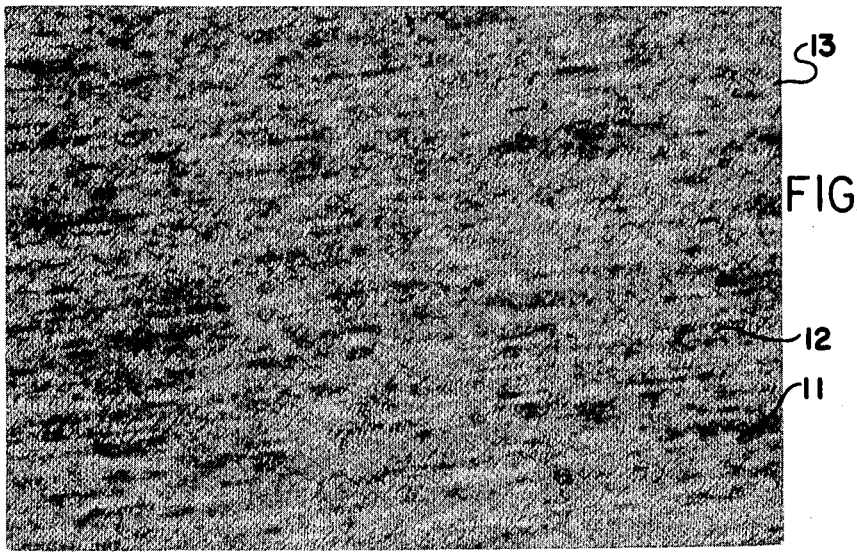
FIG. 2 is an illustration of a section of fabric produced using the yarn of FIG. 1.

The contrasting color of the predominant wrapper fibers 12 against the background of the predominant fibers of the main strand 11 provide a pronounced and attractive mottled appearance, which, when the yearn 10 is formed into a fabric 13, such as illustrated in FIG. 2, provides a randomly specked or spotted mottled fabric appearance with the predominant wrapper fiber 12 being conspicuously distributed throughout the fabric 13 against the lighter background of the predominant fibers of the main strand 11.

Figure 3:
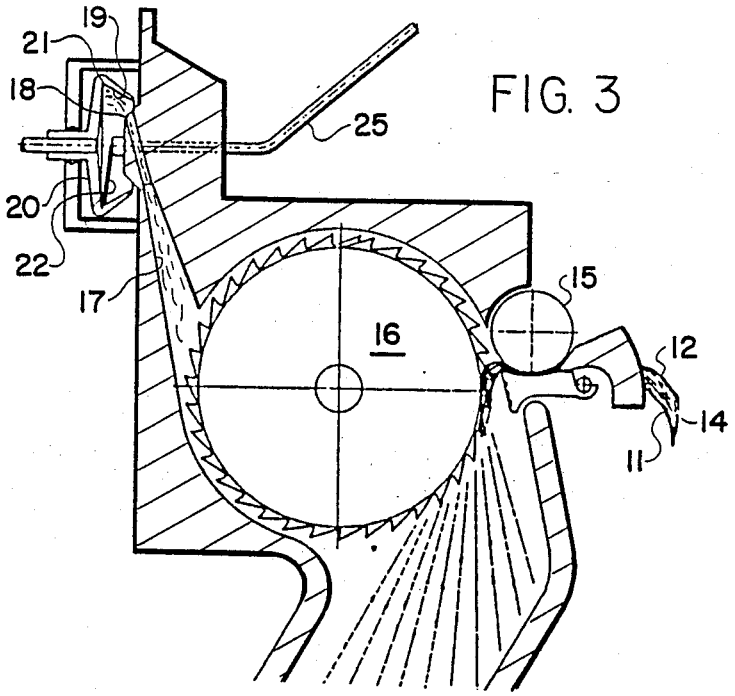
FIG. 3 is a diagrammatic illustration of an open end rotor spinning machine utilized in practicing the method of the preferred embodiment of the present invention.

According to the method of the preferred embodiment of the present invention the yarn 10 described above is produced using an open end rotor spinning machine having conventional components operating in generally conventional manner, but with a unique combination of relationships of the components and the characteristics of the fibers. The method is illustrated schematically in FIG. 3 in relation to an open end rotor spinning machine to which a sliver 14 is fed that contains a combination of fibers, including fibers best suited for forming the main strand 11 of the yarn and fibers best suited for forming wrapper fibers 12 in the yarn. The fibers for forming the main strand 11 predominate in the total composition of fibers over the wrapper forming fibers 12, which may be blended with the mains strand fibers in a single sliver or be an unblended strand within a combined sliver or may be a separate sliver fed simultaneously with a sliver of main strand forming fibers. The composition of fibers in whatever form is fed by a feed roll 15 to an opening roll 16 that separates the fibers individually from the sliver and directs them to a feed tube 17 that has an exit 18 adjacent the inner conical wall 19 of a rotor 20. the fibers are received on the conical wall 19 and slide along the wall into a groove 21 in which fibers are collected and then drawn off and twisted to form a strand 22 that passes through the opening 23 in a navel 24 and then through a draw-off tube 25 from which it exits as the aforementioned yarn 10.

The relationship of the fiber characteristics explained above are in turn related to the selected components of the spinning machine, particularly the rotor, to induce wrapper fiber formation by the wrapper forming fibers. The formation of wrapper fibers in producing open end rotor spun yarns is a phenomenon that is wellknown in the art as a disadvantage that is to be minimized to the fullest extent possible. Common factors that influence the formation of wrapper fibers are the shape and movement of the draw-off tube and associated navel, the rotor speed, the rotor diameter, the length of the zone in which the fibers are initially being twisted together and removed from the rotor groove, the fiber length and the coefficient of friction. These factors are adjusted in co-relation to obtain the desired yarn qualities, usually qualities approaching as closely as possible those of ring spun yarn, with a minimization of formation of wrapper fibers. The wrapper fiber formation is also dependent on the size of the fibers in terms of thickness, which with the length of the fibers and the diameter of the rotor will directly affect wrapper fiber formation.

Figure 4:
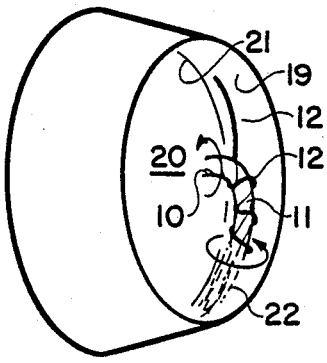
FIG. 4 is a diagrammatic illustration showing fibers being fed to and withdrawn from the rotor included in FIG. 3.
Figure 5:
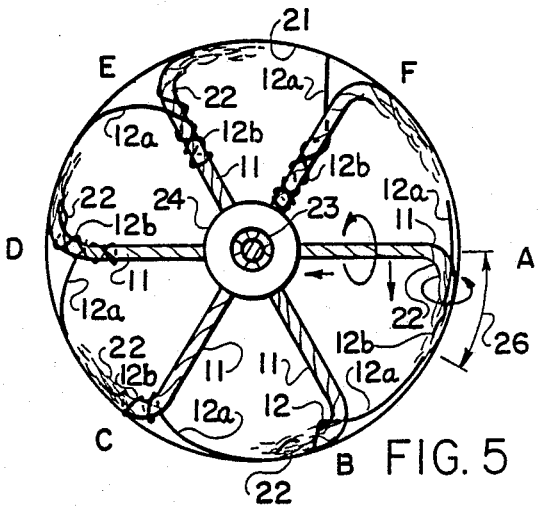
FIG. 5 is a diagrammatic illustration of the formation of wrapper fibers in the rotor of FIG. 4.

The formation of wrapper fibers is illustrated schematically in relation to a rotor 20 where the aforementioned strand 22 is illustrated as it is being drawn from the rotor groove 21 with fibers being imparted with twists as they are withdrawn from an initially generally parallel relationship in the rotor groove 21. The zone in which this is occurring is indicated by the arcuate arrow 26. It is in this zone that the initial formation of wrapper fibers is developed. This zone can be lengthened or shortened by varying operating factors of the machine as is well-known to minimize or maximize wrapper fiber formation. Wrapper fibers particularly develop from those fibers that are being fed into the rotor 20 from the feed tube 17 as the draw-off strand 22 and the initial formation zone 26 revolve past the end 18 of the feed tube 17 as the rotor revolves. As seen in FIG. 4 some of the fibers introduced at this point lay over the strand 22 as it leaves the rotor groove 21 without being twisted into the strand. A fiber of this type is indicated as the wrapper fiber 12 described above. The inter-engagement of the wrapper fiber 12 with the strand 22 as the strand revolves in relation to the rotating rotor is illustrated in progressive stages in FIG. 5. In stage A the wrapper fiber 12 is laying untwisted along the formation zone with a trailing end 12*a* projecting beyond the zone and strand 22 in a trailing direction with respect to the revolving motion of the strand. The other end 12*b* of the wrapper fiber 12 extends along the zone untwisted with the other fibers. At stage B the strand 22, as it rotates in leaving the collection groove 21 of the rotor 20, causes an initial wrapping of the center portion of wrapper fiber 12 with an S twist while the trailing end 12*a* remains projecting untwisted. This S twisting of the leading end 12*b* of the wrapper yarn progresses through stages C and D, and in stage D the trailing end 12*a* begins to be drawn from the rotor groove 21, with the rotation of the strand 22 and the previous wrapping of the center portion of the wrapper fiber 12 around the strand 22 causing the trailing end 12*a* to be wrapped around the strand 22 with a Z twist. This continues through stage E, and in stage F it is seen that the wrapper fiber 12 has been wrapped around the strand 22 and carried from the rotor to be a securely wrapped wrapper fiber 12 in the ultimate yarn.

Fibers that are long in relation to the diameter of the rotor will be more likely to extend across a formation zone in a manner to form wrapper fibers than a fiber that is relatively short in relation to the diameter of the rotor. Similarly, a coarse fiber would be more likely to resist initial twisting and formation in a strand than a fine fiber. Of course, a combination of long and coarse characteristics would be additive in the tendency to produce wrapper fibers.

By the present invention, a combination of fibers is fed to the rotor with some fibers being purposely longer or coarser or longer and coarser than other fibers, with the result that these longer or coarser fibers are more likely to form wrapper fibers than the shorter or finer fibers. By combining this composition of fibers with a difference in color characteristics, the wrapper fibers can be made to be conspicuous, contrary to the conventional practice of minimizing the presence and conspicuousness of wrapper fibers. Obviously, some of the longer and coarser wrapper fiber forming fibers are twisted properly into the main strand and some of the shorter, finer main strand forming fibers become wrapper fibers, but by using fibers of distinctly different lengths or coarseness or both and by having the shorter or finer fibers predominate in the total composition of fibers, a concentration of the longer and coarser fibers as wrapper fibers will result and provide the desired features of the present invention.

The length of the fiber in relation to the diameter of the rotor is directly related to the formation of wrapper fibers as the longer the fiber is in relation to the diameter of the rotor the more likely the fiber is to extend across a formation zone and the more often the formation zone will pass the exit end 18 of the feed tube 17 at normal operating speeds, causing more frequent pick-up of fibers that become wrapper fibers on the yarn.

In order to operate effectively to produce a rotor spun yarn with sufficient strength and desired hand, the ratio of the rotor diameter to the fiber length is conventionally kept above approximately 1.2 with a ratio of 0.8 being considered the lowest ratio theoretically possible. In the preferred embodiment of the present invention the fiber length of the wrapper fiber forming fibers and the diameter of the rotor are selected to maximize wrapper fiber formation while maintaining other desirable qualities in the yarn, by selecting fibers and rotor where the ratio of the rotor diameter to the length of the wrapper fiber forming fibers is in the range of approximately 0.8 to 1.2, preferably closer to 0.8 than 1.2, and in an optimum relationship, a ratio of 0.95 has been found to be particularly advantageous in balancing wrapper fiber formation and other normally desired characteristics in the yarn. This has been accomplished using a relatively small rotor of approximately 36 millimeters in diameter and a relatively long fiber of approximately 1½ inches in length. In this particular example, the wrapper fiber forming fibers are either acrylic or nylon and the main strand forming fibers are a blend of cotton and polyester, with the cotton fibers being approximately one inch long and the polyester fibers being approximately one and one-quarter inch long, resulting in a ratio of rotor diameter to fiber length of 1.44 for the cotton fibers and approximately 1.12 for the polyester fibers. The combination of fibers in this particular example, which produces advantageous attractive wrapper fiber formation, has a predominance of main strand fibers, being approximately 42% cotton, approximately 42% polyester and approximately 16% acrylic or rayon. However, it is not important that the fibers be of different material or be of any particular composition mix other than that the main strand forming fibers predominate so that the main strand will provide a background against which the lesser number of wrapper fibers will form a conspicuous mottled specked or spotted appearance in the ultimate yarn and fabric.

In the specific example mentioned, the wrapper fiber forming fibers are of a thickness of approximately one and one-half denier, which is relatively coarse and enhances wrapper fiber formation. On the other hand, the cotton fibers are of a size approximately the equivalent of three to four micronaire and the polyester fibers are of a size approximately the equivalent of one denier. This coarseness relationship, can, of course, be varied in providing a mottle effect of varying degree and conspicuousness.

In the specific example given, the wrapper fiber forming fibers are both longer and coarser than either of the main strand forming fibers. However, it is not essential that the fibers differ significantly in both length and coarseness as a significant difference in one of these characteristics could be sufficient to provide acceptable results. In the example given the wrapper fiber forming acrylic or nylon fibers are approximately 50% longer than the cotton fibers and are of a denier approximately 50% greater than the polyester, while being less than 50% longer than the polyester and less than 50% thicker than the cotton. It is believed that desirable results can be obtained with the wrapper fiber forming fibers being approximately 50% or more greater than the main strand forming fibers in either length of thickness, although considerable variation from this would provide satisfactory, though possibly not as conspicuous results.

Figure 6:
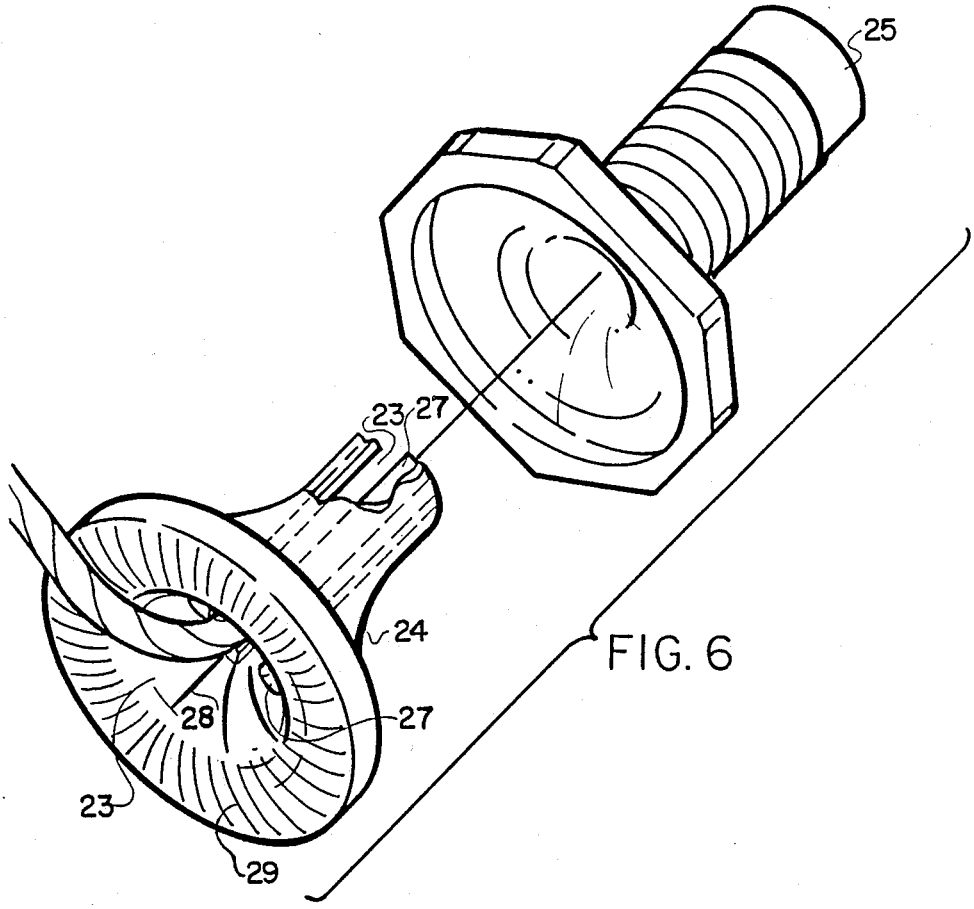
FIG. 6 is a perspective view of the navel included in the components illustrated in FIG. 3.
Figure 7:
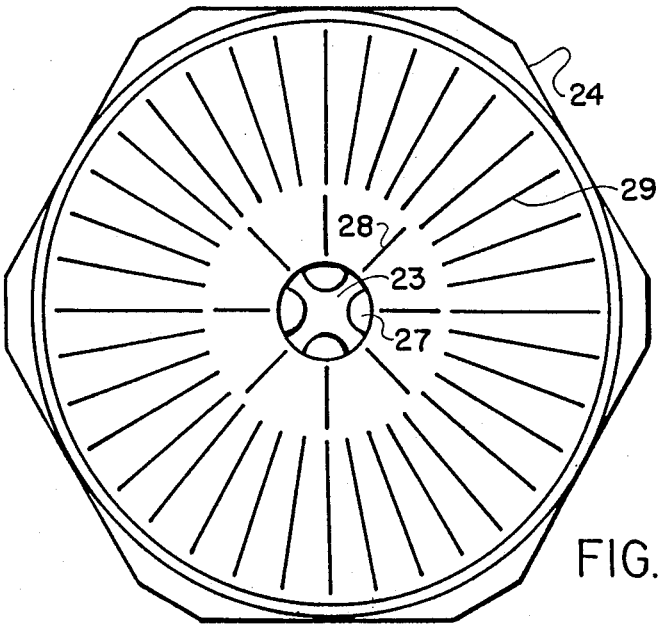

In practicing the present invention, enhanced results can be obtained in terms of the wrapper fiber effect in a yarn that has optimum qualities otherwise by the use of an aggressive navel action. An example of a navel that can be used to provide such aggressive action is illustrated in FIG. 6. This is a commercially available navel 24 having a trumpet-like yarn passage 23 shaped with flutes 27, arcuate grooves 28 and knurls 29. The action of such an aggressive navel reduces the harshness in the ultimate yarn and also enhances the wrapping of the longer and coarser fibers around the shorter and finer fibers as the strand is withdrawn from the rotor groove. Conventionally, reducing the ratio of the rotor diameter to fiber length makes a tight wrapper, but by utilizing an aggressive navel action this tightness is controlled to reduce harshness optimally.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A method of producing an open end rotor spun yarn having a mottled appearance comprising:

feeding a combination of fibers including fibers for forming a main strand and fibers for forming wrapper fibers around said main strand to an opening roll for separating said main strand forming fibers and said wrapper forming fibers from the other fibers of the combination of fibers, said main strand forming fibers including predominant fibers of particular characteristics, and said wrapper forming fibers including predominant fibers of particular characteristics, said characteristics of said predominant wrapper forming fibers including greater wrapper fiber forming, lesser main strand forming and different color characteristics than said characteristics of said predominant main strand forming fibers;

feeding the individually separated main strand forming and wrapper forming fibers to a rotor;

manipulating said main strand forming and wrapping forming fibers with said rotor; and withdrawing said fibers from said rotor in the form of a yarn, thereby inducing wrapper fiber formation by said wrapper forming fibers to produce a yarn having a mottled appearance.

2. A method of producing an open end rotor spun yarn according to claim 1 and characterized further in that said manipulating with said rotor includes manipulating with a rotor of relatively small diameter in comparison with the length of the wrapper forming fibers.

3. A method of producing an open end rotor spun yarn according to claim 2 and characterized further in that said manipulating with said rotor includes manipulating with a rotor wherein the ratio of the diameter of the rotor to the length of the wrapper forming fibers is less than approximately 1.2 and the ratio of the diameter of the rotor to the length of the main strand forming fibers is greater than said ratio of the rotor diameter to the length of the wrapper forming fibers.

4. A method of producing an open end rotor spun yarn according to claim 2 and characterized further in that in said manipulating with said rotor the ratio of the diameter of the rotor to the length of the wrapper forming fibers is more nearly 0.8 than 1.2.

5. A method of producing an open end rotor spun yarn according to claim 2 and characterized further in that in said manipulating with said rotor the ratio of the diameter of the rotor to the length of the wrapper forming fibers is approximately 0.95.

6. A method of producing an open end rotor spun yarn according to claim 4 and characterized further in that said feeding of fibers includes feeding a combination of cotton and polyester fibers for forming a main strand of yarn and fibers selected from acrylic and rayon fibers for forming said wrapper fibers on said yarn.

7. A method of producing an open end rotor spun yarn according to claim 5 and characterized further in that said feeding of fibers includes feeding a combination of cotton and polyester fibers for forming a main strand of yarn and fibers selected from acrylic and rayon fibers for forming said wrapper fibers on said yarn.

8. A method of producing an open end rotor spun yarn according to claim 7 and characterized further in that the ratio of the rotor diameter of the length of the fibers is approximately 1.44 for the cotton fibers and approximately 1.12 for the polyester fibers.

9. A method of producing an open end rotor spun yarn according to claim 8 and characterized further in that said feeding of fibers includes feeding a combination of approximately 16% wrapper forming fibers, approximately 42% cotton fibers and approximately 42% polyester fibers.

10. A method of producing an open end rotor spun yarn according to claims 2, 3, 4, 5, 6, 7, 8 or 9 and characterized further in that said feeding of fibers to a rotor comprises feeding said fibers to a rotor having a diameter of approximately 36 millimeters.

11. A method of producing an open end rotor spun yarn according to claims 1, 2, 3, 4, 5, 6, 7, 8 or 9 and characterized further by drawing said fibers from said rotor through a navel while applying aggressive navel action to reduce twisting and enhance softness of the resultant yarn.

12. A method of producing an open end rotor spun yarn according to claim 11 and characterized further in that said feeding of fibers to a rotor comprises feeding said fibers to a rotor having a diameter of approximately 36 millimeters.

* * * * *